United States Patent [19]

Banks

[11] Patent Number: 4,951,408

[45] Date of Patent: Aug. 28, 1990

[54] PAPER CLIP TAB DEVICE

[76] Inventor: Thomas S. Banks, 1012 Summertree Circle, Plano, Tex. 75025

[21] Appl. No.: 310,914

[22] Filed: Feb. 16, 1989

[51] Int. Cl.[5] ..... G09F 3/16

[52] U.S. Cl. ..... 40/641; 40/359; 24/67.9

[58] Field of Search ..... 40/641, 359, 360, 604, 40/638, 665; 24/306, 67.9, 67.3, 67 R

[56] References Cited

U.S. PATENT DOCUMENTS

| | | | |
|---|---|---|---|
| 1,476,420 | 12/1923 | Romig | 24/67.9 |
| 2,118,043 | 5/1938 | Goza | 40/641 |
| 3,225,469 | 12/1965 | Chase | 40/641 |
| 3,231,992 | 2/1966 | Swett | 40/665 |
| 3,290,810 | 12/1966 | Morena | 40/641 |
| 3,994,085 | 11/1976 | Groselak et al. | 40/665 |
| 4,019,759 | 4/1977 | Stanton | 40/360 |
| 4,232,461 | 11/1980 | Crawford | 40/641 |
| 4,726,607 | 2/1988 | White | 40/308 |

*Primary Examiner*—Peter R. Brown
*Assistant Examiner*—Brian K. Green
*Attorney, Agent, or Firm*—Leon Gilden

[57] ABSTRACT

A paper clip tab device is set forth wherein a paper clip has secured at a terminal loop thereof a tab marker formed with securable surfaces positioned adjacent a pivot hinge formed with recessed upper and lower surfaces and arcuate side edges extending inwardly of the hinge wherein the tab marker is formed of a planar flexible sheet of a width substantially equal to that of the paper clip such that securement of the tab marker to the paper clip is accommodated within the arcuate recesses of the pivot hinge. The marker further includes a transparent cover defining an interiorly directed configuration is complementary to that of an insertable planar tab to frictionally squeeze the tab within the transparent cover.

8 Claims, 1 Drawing Sheet

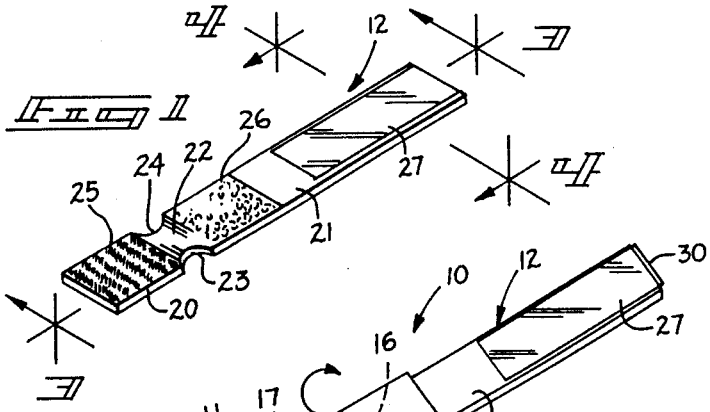
Fig 1
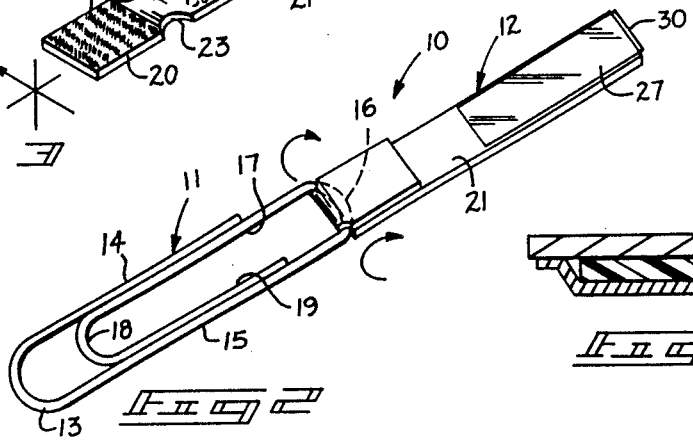
Fig 2
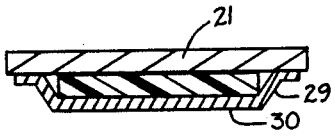
Fig 4
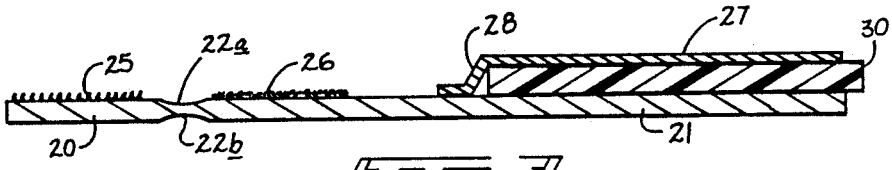
Fig 3
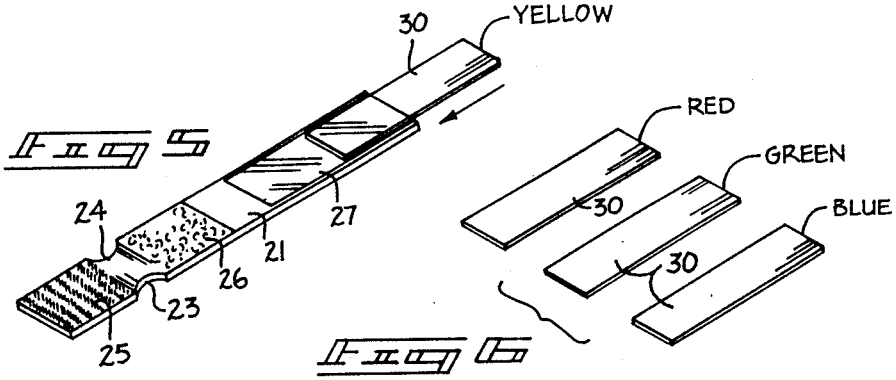
Fig 5
Fig 6

PAPER CLIP TAB DEVICE

BACKGROUND OF THE INVENTION

1. Field of the Invention

The field of invention relates to tab markers, and more particularly pertains to a new and improved paper clip tab device wherein the same is provided with insertable tabs positionable within a transparent viewing cover for visual indication in use for filing and the like.

2. Description of the Prior Art

The use of marking and indicating devices are well known in the prior art. The securement of markers and markers with paper clip-type configurations are utilized to indicate various positions within a filing system, for example. The markers of the past have generally been of a configuration to overlie the paper clip, as opposed to the instant invention providing an upwardly extending tab marker for clarity of indication of the paper clip and tab marker in association with a paper to be indicated. For example, U.S. Pat. No. 2,690,624 to Phillips sets forth a sign device utilizing a foldable clip member securable overlying a spring clip for securement to a paper or board to be indicated. The Phillips device utilizes an indicating sign generally conforming to the configuration of the clip, as opposed to that of the instant invention.

U.S. Pat. No. 3,225,469 to Chase sets forth a paper clip index tab device utilizing a generally "U" shaped sheath with an interior to accept the configuration in a complementary fashion of an associated paper clip. Further, U.S. Pat. No. 3,408,700, also to Chase, sets forth a variation of the former Chase patent, but essentially utilizing a clip conforming marker for indication purposes. The instant invention deviates from the Chase patents in providing an organization removably securable to a paper clip and extending generally upwardly thereof with tabs insertable within the tab marker in a friction grip arrangement with the tab marker.

U.S. Pat. No. 2,938,252 to Sheemaeker sets forth a clip-type marking device of unitary construction and of a generally "U" shaped configuration to securely mount to a paper and the like to be marked.

As such, it may be appreciated that there is a continuing need for a new and improved paper clip tab device wherein the same addresses both the problems of versatility in application and ease of use, and in this respect, the present invention substantially fulfills this need.

SUMMARY OF THE INVENTION

In view of the foregoing disadvantages inherent in the known types of tab indicator devices now present in the prior art, the present invention provides a paper clip tab device wherein the same is readily assembled and securable to an associated paper and the like for indication purposes. As such, the general purpose of the present invention, which will be described subsequently in greater detail, is to provide a new and improved paper clip tab device which has all the advantages of the prior art paper clip tab devices and none of the disadvantages.

To attain this, the present invention comprises a paper clip of a predetermined width with an associated tab member of substantially the same width including a lower plate and an upper plate pivotally joined by a pivot hinge that is formed with concave edges and concave upper and lower surfaces to secure about an exterior loop of the associated paper clip. A transparent covering defined by a fixed interior configuration frictionally receives a rectangular cross-sectional configuration elongate tab of various colorations securedly therewithin for visual indication purposes. The removability and reusability of the tab marker in association with the paper clip enables the tab marker to be recycled in the event of the paper clip being deformed and further enables indicator changes without removal of to associated paper clip from a paper it is secured to.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order than the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paper clip tab device which has all the advantages of the prior art paper clip tab devices and none of the disadvantages.

It is another object of the present invention to provide a new and improved paper clip tab device which may be easily and efficiently manufactured and marketed.

It is a further object of the present invention to provide a new and improved paper clip tab device which is of a durable and reliable construction.

An even further object of the present invention is to provide a new and improved paper clip tab device which is susceptible of a low cost of manufacture with regard to both materials and labor, and which accordingly is then susceptible of low prices of sale to the consuming public, thereby making such paper clip tab devices economically available to the buying public.

Still yet another object of the present invention is to provide a new and improved paper clip tab device which provides in the apparatuses and methods of the prior art some of the advantages thereof, while simultaneously overcoming some of the disadvantages normally associated therewith.

Still another object of the present invention is to provide a new and improved paper clip tab device wherein the same includes a tab marker selectively securable to an associated paper clip wherein the tab marker receives therewithin one of a plurality of tabs in a frictional press-fit inter-relationship These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the tab marker of the instant invention.

FIG. 2 is an isometric illustration of the paper clip tab device of the instant invention in an assembled configuration.

FIG. 3 is an orthographic view taken along the lines 3—3 of FIG. 1 in the direction indicated by the arrows.

FIG. 4 is an orthographic view taken along the lines 4–4 of FIG. 1 in the direction indicated by the arrows.

FIG. 5 is an isometric illustration of the tab marker of the instant invention illustrating the replaceable tabs therewithin.

FIG. 6 is an isometric illustration of a variety of tabs of various colorations.

DESCRIPTION OF THE PREFERRED EMBODIMENT

With reference now to the drawings, and in particular to FIGS. 1 to 6 thereof, a new and improved paper clip tab device embodying the principles and concepts of the present invention and generally designated by the reference numeral 10 will be described.

More specifically, the paper clip tab device 10 of the instant invention essentially comprises a paper clip 11 and a selectively securable tab marker 12. The paper clip 11 is formed with a first "U" shaped loop 13 aligned with a second "U" shaped loop 16 and a third "U" shaped loop 18 positioned medially of the first and second loops. Depending downwardly from the first loop 13 is a first leg 14 terminating in a fixed end with a parallel second leg 15 extending spaced from the first leg 14 and merging into the second "U" shaped loop 16. The third leg 17 of the paper clip 11 extends from the second "U" shaped loop 16 to merge into the third "U" shaped loop 18 with a fourth leg 19 depending from the third loop 18. The first, second, third, and fourth legs are aligned and parallel to one another in a non-flexed configuration of the paper clip.

The tab marker 12 is formed of a continuous planar sheet with parallel side edges and a parallel top surface overlying a parallel bottom surface. The tab marker 12 is defined by a lower plate 20 of a generally rectangular first configuration pivotally mounted to an upper plate 21 of a generally second rectangular configuration substantially greater than that of the first configuration of a lower plate 20. A pivot hinge 22 pivotally mounts the lower plate 20 to the upper plate 21 wherein the pivot hinge 22 is formed with a convex upper hinge surface 22*a* overlying a convex lower hinge surface 22*b* formed within the upper and lower surfaces between the lower and upper plates 20 and 21 respectively. The side edges of the pivot hinge 22 are formed with an inwardly directed first arcuate recess 23 aligned with an opposed mirror image second arcuate recess 24. The width of the upper and lower plates are substantially equal to the width of the second and third legs of the paper clip such that the lower plate 20, when secured about the second "U" shaped loop, receives the second "U" shaped loop 16 in a non-binding configuration as depends outwardly of the pivot hinge 22 and is received within the first and second arcuate recesses 23 and 24 in a non-binding manner. A first hook and loop fastener section 25 is secured onto the upper surface of the lower plate 20 with a complementary second hook and loop fastener section 26 positioned adjacent the pivot hinge section on the upper plate 21 to enable selective securement of the upper and lower plate together about the paper clip 11. Spaced above the second loop fastener section 26 is an elongate transparent cover formed with an open end an aligned with the upper edge of the upper plate 21. The transparent cover defines a cross-sectional configuration of generally trapezoidal configuration interiorly thereof to receive a tab marker 30 of a generally rectangular configuration. The rectangular configuration of the tab marker is complementary to that of the third configuration defined by the transparent cover to frictionally engage and secure the tab marker within the transparent cover in a press-fit relationship. The tab marker 30 is of a length greater than that of the upper surface of the transparent cover to extend somewhat beyond the transparent cover and the aligned edge of the upper plate 21 to enable manual grasping thereof for replacement of the tab marker. The transparent cover 27 is formed with a continuously enclosed lower perimeter 28 and a continuously enclosed side perimeter 2 to frictionally secure the tab 30 therewithin. The tab 30 may be formed of various colorations, as illustrated in FIG. 6, and may be further provided with written indicia, but it is desirable for the various colorations to be utilized to enhance at-a-glance visual recognition of the tabs when positioned and secured to an associated paper within a filing system or as a book mark indicator and the like.

As to the manner of usage and operation of the instant invention therefore, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principle of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A paper clip tab device for visual indication of sheet material comprising, in combination, a paper clip including an aligned first loop, a second loop, and a third loop oriented medially of said first and second loops, and a second leg joining the first and second loops, a third leg joining the second and third loops, and a first and fourth leg of the paper clip terminating in a free end depending from the first and third loops respectively, said first, second, third, and fourth legs are spaced and parallel to one another, and the second and third legs define a predetermined width, and an elongate tab marker including securement means for selective securement of said tab marker to the first loop or the second loop, and wherein the tab marker includes a lower plate hingedly mounted to an aligned upper plate, the lower plate and upper plate include parallel side edges and parallel upper and lower surfaces, and wherein the securement means includes a first hook and loop fastener section secured to an upper surface of the lower plate adjacent a pivot hinge pivotally securing the lower plate and upper plate together, and a second hook and loop fastener section secured to an upper surface of the upper plate adjacent the pivot hinge.

2. The paper clip tab device as set forth in claim 1 wherein the pivot hinge includes a concave upper and lower surface and an inwardly directed arcuate recess extending inwardly of opposed sides of the pivot hinge for accommodating the first loop or the second loop of the paper clip in complementary orientation when the first hook and loop fastener section is secured to the second hook and loop fastener section.

3. The paper clip tab device as set forth in claim 2 wherein a width defined by the tab marker between the side edges thereof is substantially equal to the predetermined width.

4. The paper clip tab device as set forth in claim 3 including a transparent cover spaced above the second hook and loop fastener section of the upper plate wherein the transparent cover defines a predetermined geometrical configuration therewithin.

5. The paper clip tab device as set forth in claim 4 wherein a tab of a second predetermined geometric configuration is complementary to that of the first geometric configuration and is frictionally receivable within the transparent cover.

6. The paper clip tab device as set forth in claim 5 wherein the transparent cover defines an upper surface, and the tab defines a length greater than that of the upper surface of the transparent cover to extend outwardly to the transparent cover for manual grasping of the tab.

7. The paper clip tab device as set forth in claim 6 wherein the tab is provided in a plurality of colorations.

8. The paper clip tab device as set forth in claim 7 wherein the transparent cover defines a trapezoidal cross-sectional configuration between the cover and the upper surface of the upper plate, and the tab defines a rectangular cross-sectional configuration.

* * * * *